US005419230A

United States Patent [19]

Ocheltree et al.

[11] Patent Number: 5,419,230

[45] Date of Patent: May 30, 1995

[54] SNARE DRUM

[76] Inventors: Jeffrey Ocheltree, 1 Parkwood Dr., Davenport, Iowa 52803; Tom Wilson, P.O. Box 112, Albany, Ill. 61230

[21] Appl. No.: 258,501

[22] Filed: Jun. 10, 1994

[51] Int. Cl.[6] ..... G10D 13/02

[52] U.S. Cl. ..... 84/415

[58] Field of Search ..... 84/411 R, 415

[56] References Cited

U.S. PATENT DOCUMENTS

| | | | |
|---|---|---|---|
| 3,981,220 | 9/1976 | Clark | 84/415 |
| 4,206,681 | 6/1980 | Kluczynski et al. | 84/411 R |
| 4,903,569 | 2/1990 | Kurosaki | 84/413 |

*Primary Examiner*—M. L. Gellner
*Assistant Examiner*—Patrick J. Stanzione
*Attorney, Agent, or Firm*—Rockey, Rifkin & Ryther

[57] ABSTRACT

This disclosure is of a novel drum, specifically a snare drum which is capable of producing a definite pitch or note. The prior art drums did not produce a definite or definitive pitch. This disclosure is of a drum and the process of assembling it with a seamless shell, the skin being held tautly over the machined bearing surfaces of said shell. The drum may be tuned to other definite pitches by a tuning mechanism between the lugs on the hoop holding the skin firmly against the bearing surface of the shell and tuning lugs attached to the shell. The lugs in the shell holding the tuning means are also made of metal to enhance the tonal response of the seamless shell. The snare bed is enlarged both in width and depth and is a part of a machined bearing surface to also enhance the tonal response of the snare.

14 Claims, 2 Drawing Sheets

SNARE DRUM

BACKGROUND OF THE INVENTION

This invention relates to drums and more specifically to snare drums. Drums have been in existence for many centuries and generally consist of one or two membranes or skins stretched across the face of a shell. The shells, indeed drums, are made in a multitude of shapes, materials and fastening devices. Drum types include kettle drums, tom toms, snare and others. Historically none of the drum types except the kettle drum could be given a definitive or definite pitch. This has been the result of irregularities of the partials above the fundamental. The irregularities of the partials may result from shell imperfections and/or lack of uniformities of material and the thickness of the shell and/or skin and the fastening methods.

Some drums have strings across the snare head which pick-up the resonant vibrations of the batter head or struck head sharpening the sound and giving a rattling timber sound.

SUMMARY OF THE INVENTION

An objective of the present invention is to provide a snare drum which "rings" and which has a definite pitch or note.

A further advantage of this novel invention is the ability to produce drums having the ability to be tuned to a basic pitch which may then be tuned up or down while retaining the definite pitch of the new note.

The present invention achieves these novel properties by the combination of several improvements in the snare drum. The present invention uses a seamless shell made of metal. Prior art metal shells have always had seams where the flat metal was rolled into a shell and welded into place. The shell of the present invention is precision machined after having been extruded or casted as a seamless hollow cylinder. This seamless shell is then machined to precise and uniform thickness of the shell as well as of the bearing edges. The bearing edges of shell differ in angular relationship to the shell surfaces and the thickness of the bearing edges at the bonding point for the skin also differs from the prior art.

The pitch or note desire may be arrived at by choosing the appropriate metal. Carbon steel or brass have been utilized currently to make the shell. The thickness of the shell may be precisely varied to produce various pitches.

The snare bed of this invention is larger and of a different configuration from the prior art. The bed is wider and deeper than the prior art and results in better vibrations of the snare from the resonating of the skin.

The present invention also utilizes hoops made of die cast metal. This improved hoop also enhances the note or pitch produced by the drum. The hoops are also made uniform and of desired dimensions which helps generation the definite pitch.

Other objects, advantages and embodiments of the invention will become apparent upon reading the following detailed description and upon reference to the drawings and to the prior art.

BRIEF DESCRIPTIONS OF THE DRAWINGS

DETAILED DESCRIPTION OF THE PREFERRED EMBODIMENT OF THE INVENTION

Figure 1:
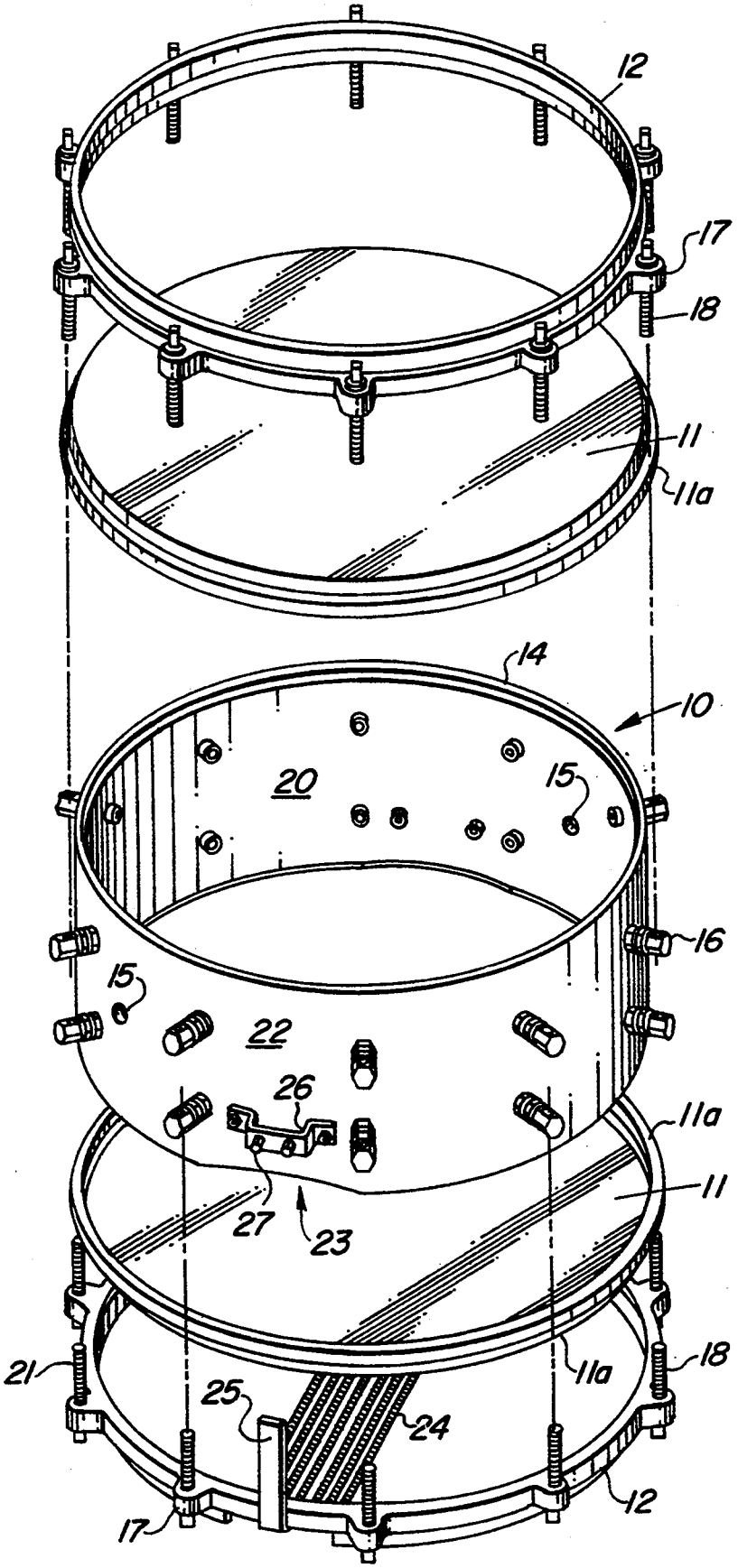
FIG. 1 is an exploded view of a snare drum embodying the invention including shell, hoops and skin.

Referring first to FIG. 1, where the entire drum of this invention is shown. The process of making the drum and the resultant drum will be described with reference to the drawings.

The shell 10 is made of metal and may be extruded or cast so that the shell 10 is seamless. The metal may be carbon steel or brass depending on the pitch desired. The shell 10 is extruded with walls thicker than the desired thickness of the shell 10 when made into a drum.

The shell 10 is then precision machined to exact and desired wall thickness. In one embodiment of the invention to produce a C sharp or a B flat pitch, carbon steel was machined to a wall thickness of three-sixteenths of an inch.

Figure 2:
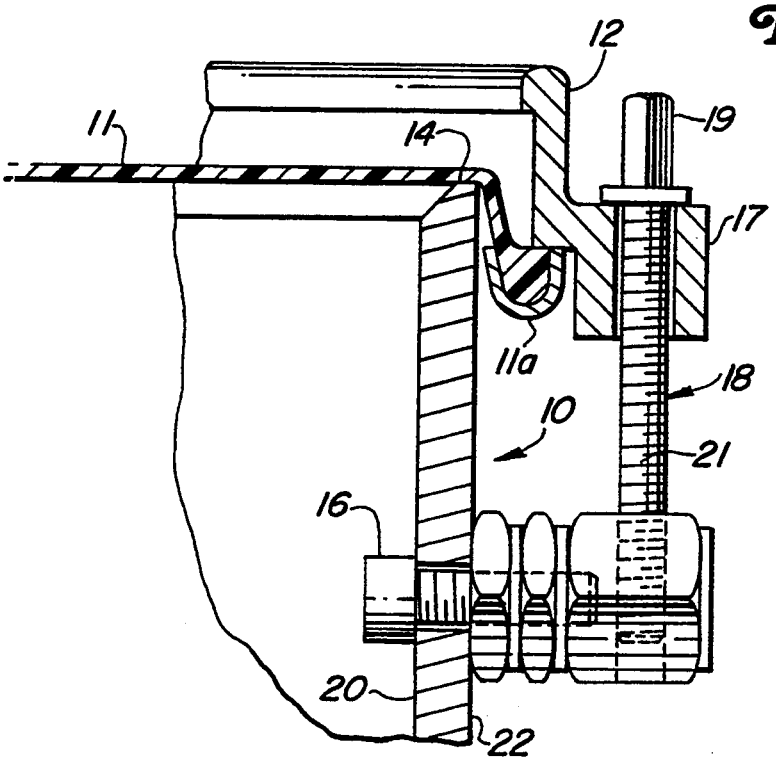
FIG. 2 is a sectional view showing in detail the novel bearing edges, the skin, the hoop with tuning mechanism attached.
Figure 3:
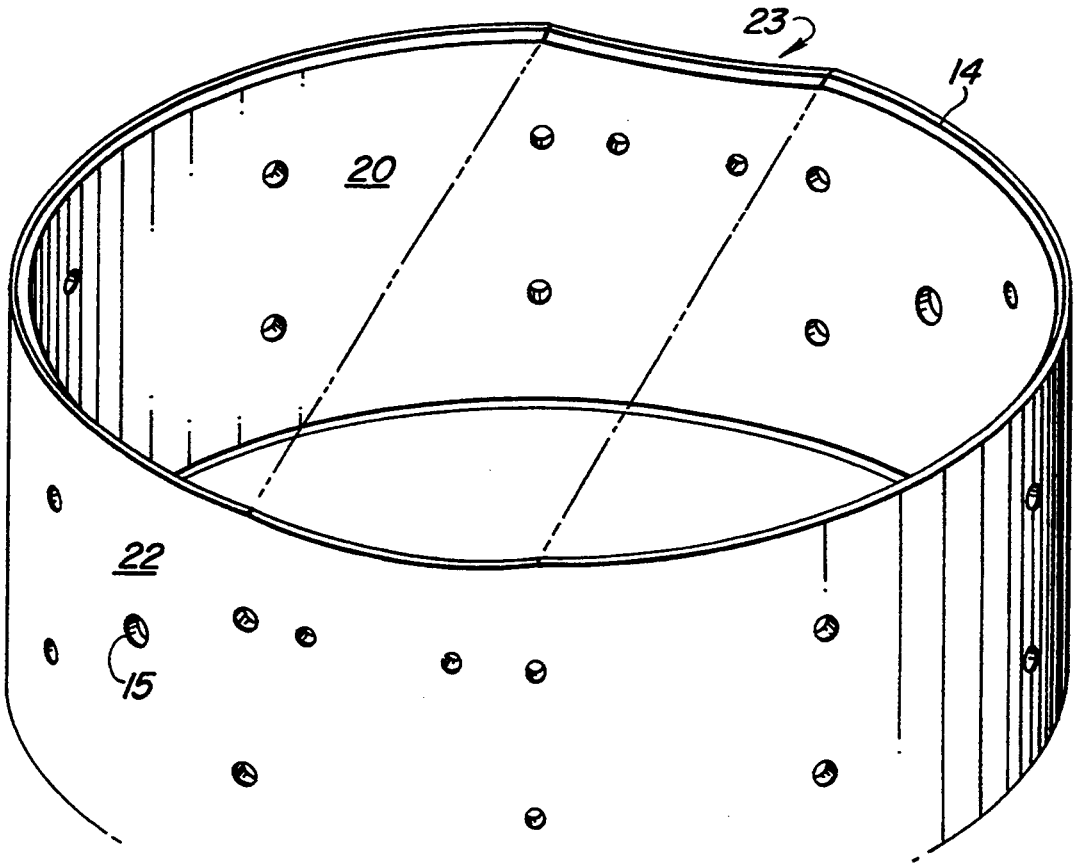
FIG. 3 is a sectional view showing the novel snare bed formed in one bearing edge of the shell.

The bearing edges 14 are precision machined so that the surface 14 is no more than three-sixty fourths of an inch wide. The inside wall 20 is tapered at an angle of 45° from the vertical inside surface of the shell 10. The exterior surface 22 of the shell is formed either 90° to the exterior surface 22 as shown in FIG. 2 or may be tapered at 30° from the vertical retaining the three-sixty fourths of an inch width of the bearing edge.

The air vents 15 in the shell are filled with metallic inserts secured onto the shell 10 both inside and outside. This enhances and/or maintains the vibrational quality of the seamless shell 10.

A skin 11 is contained at its circumference by a metallic member 11A holding the skin so that it may be tensioned by the hoop 12 and its associated tightening members. The tightening members are a plurality lugs 16 securely affixed to the shell 10. These lugs 16 are threaded as shown in FIG. 2.

A hoop 12 made of a die cast metal and having a plurality of lugs 17 which are aligned with lugs 16 for tightening the skin 11 which results in tuning of the drum. The lugs 17 on the hoop 12 are not threaded but restrain the bolts 18. By turning bolts 18 with their heads 19 moves the hoop 12 vertically as bolts 18 are rotated to tighten or loosen with the threads 21 of the bolts 18 in the lugs 16. The vertical movement of the hoop tightens or loosens skin 11 against the bearing edge 14 and results changes of the pitch or note produced by the drum. The lugs are of a high quality and high strength metal to enhance the integrity of the shell.

The resonant or snare head end of the shell 10 has a bed 23 for the snare machined in the face of the shell. This bed holding the snare allows the snare 24 to resonate with the skin 11. The snare bed 23 is longer and deeper than prior art snare beds. This novel snare bed size permits the snare to respond to the resonance with a sharp rattle, because of its closer proximity to the skin 11. The snare bed and the embodiment of this invention was 5 inches along the circumference and three-thirty seconds of an inch in depth into the bearing edge 14 of the shell 10. The snare is attached to the shell 10 by a number secured in bracket 26 by screw number 27.

The drum of this invention is made by the process of having:

1. A seamless circular tube or shell made of metal;

2. Precision machining said shell to a uniform thickness;
3. Machining to a precise dimension a bearing surface on said shell for the skin to bear upon;
4. Inserting lugs through said shell;
5. Machining a snare bed in said bearing surface;
6. Die casting hoops with lugs for holding in cooperation with lugs on the shell the skin taut against the machined bearing surfaces;
7. Means for holding the snare in the snare bed firmly against the skin;
8. Assembling the parts to form a drum.

The drum made in accordance with this process will have a definite pitch which may be predetermined.

Variations and other aspects of the preferred embodiment will occur to those versed in the art all without departure from the spirit and scope of the invention.

What is claimed is:

1. A drum for generating a definite pitch comprising:
a) A seamless metallic shell having a continuous wall with an inner and an outer surface;
b) Bearing surfaces machined on the ends of said shell;
c) A snare bed in one of said bearing surfaces;
d) Lugs extending through the wall and exiting the exterior surface;
e) Air holes in said wall;
f) A skin;
g) A hoop having lugs thereon for securing said skin to said bearing surfaces of said shell in cooperation with said lugs on said shell;
h) Tuning means connected between the lugs on said shell and lugs on said hoop to vary the tension of said skin;
i) Snare means mounted in said snare bed and secured to said shell whereby a definite pitch is generated when the skin is resonated.

2. A drum according to claim 1, wherein said shell has a wall thickness of three-sixteenths of an inch.

3. A drum according to claim 1, wherein said shell is made of carbon steel.

4. A drum according to claim 2, wherein said shell is made of brass.

5. A drum according to claim 1, wherein said bearing surface is no more than three-sixty fourths of an inch.

6. A drum according to claim 1, wherein said bearing surface is one-forth of the wall thickness or less.

7. A drum according to claim 1, wherein said bearing surface is tapered at 45° from the inner surface of the wall of said shell.

8. A drum according to claim 1, wherein the bearing surface is tapered at 30° from the outer surface of the wall of said shell.

9. A drum according to claim 1, wherein said hoop is made of die cast metal.

10. A drum according to claim 1, wherein the tuning means is connected between the lugs on said loop and the lugs on said shell.

11. A drum according to claim 10, wherein the tuning means is a threaded bolt passing through the lugs of said hoop and engaging threads in the lugs on said shell.

12. A drum according to claim 1, wherein said snare bed is at least 5 inches long and at least three-thirty seconds inches deep.

13. A drum for generating a definite pitch comprising:
a) A seamless metallic shell having a continuous wall having a thickness of three-sixteenths of an inch with an inner and an outer surface;
b) Bearing surfaces machined on the ends of said shell, said bearing surfaces being one-fourth or less of the wall thickness on the ends of said shell;
c) A snare bed in one of said bearing surfaces of said bed, being at least five inches long and at least three-thirty seconds deep;
d) Lugs extending through the wall and exiting the exterior surface, said lugs having threads in the vertical direction;
e) Air holes in said wall;
f) A skin;
g) A hoop having lugs thereon for securing said skin to said bearing surfaces of said shell in cooperation with said lugs on said shell;
h) Tuning means connected between the lugs on said shell and lugs on said hoop to vary the tension of said skin;
i) Snare means mounted in said snare bed and secured to said shell whereby a definite pitch is generated when the skin is resonated.

14. The process for making a drum comprising the steps of:
a) Forming a seamless circular tube or shell made of metal;
b) Machining said shell to a uniform thickness;
c) Machining to a precise dimension a bearing surface on said shell for the skin to bear upon;
d) Inserting lugs through said shell;
e) Machining a snare bed in said bearing surface;
f) Die casting hoops with lugs for holding in cooperation with lugs on the shell the skin taut against the machined bearing surfaces;
g) Inserting means for holding the snare in the snare bed firmly against the skin;
h) Inserting skin in said skin holder;
i) Assembling the above parts to form a drum.

* * * * *